US006352498B1

(12) United States Patent
Chiu Chen

(10) Patent No.: US 6,352,498 B1
(45) Date of Patent: Mar. 5, 2002

(54) MATERIAL PICKING AND FORMING DEVICE FOR AN AUTOMATIC CIRCULATING CARTON OPENING MACHINE

(75) Inventor: Tuan-Mei Chiu Chen, Chia Yi Hsien (TW)

(73) Assignee: Tien Heng Machinery Co., Ltd., Chia Yi Hsien (TW)

( * ) Notice: Subject to any disclaimer, the term of this patent is extended or adjusted under 35 U.S.C. 154(b) by 0 days.

(21) Appl. No.: 09/484,237

(22) Filed: Jan. 18, 2000

(51) Int. Cl.[7] ..... B31B 3/26; B31B 3/04
(52) U.S. Cl. ..... 493/315; 493/52
(58) Field of Search ..... 493/51, 55, 123, 493/124, 126, 127, 314, 315

(56) References Cited

U.S. PATENT DOCUMENTS 3,648,573 A * 3/1972 Le Febvre et al. ..... 93/51
3,648,605 A * 3/1972 Hottendorff ..... 101/232
5,312,316 A * 5/1994 Wu ..... 493/123

* cited by examiner

*Primary Examiner*—Rinaldi I. Rada
*Assistant Examiner*—Chukwurah Nathaniel
(74) *Attorney, Agent, or Firm*—Rosenberg, Klein & Lee

(57) ABSTRACT

A material picking device and a forming device for an automatic circulating carton opening machine are fixed on the table of the machine. The material picking device has a revolving unit including a swinging arm, two rotatable gear units fixed at two ends of the swinging arm. Each gear unit has an outermost belt wheel connected to a parallel arm, and a sucking disc fixed with the parallel arm. The forming device has a forming guide plate fixed on an intermediate portion of the table of the machine in front of the revolving unit and located at one side of the moving route of the swinging arm. The two parallel arms fixed with the sucking discs are moved horizontal to let the sucking discs to alternately and continuously pick a carton material board out of the material feed device of the machine to carry onto the forming guide plate for forming a carton shape. So operating of the machine is speeded up largely.

4 Claims, 9 Drawing Sheets

MATERIAL PICKING AND FORMING DEVICE FOR AN AUTOMATIC CIRCULATING CARTON OPENING MACHINE

BACKGROUND OF THE INVENTION

This invention relates to a material picking device and a forming device for an automatic circulating carton opening machine, particularly to one having a revolving unit to swing around to continuously and quickly picking material carton boards from a material feed device of the machine and carrying them onto the forming guide plate to form the material into a carton shape.

As for cartons packed automatically, opening, forming and adhering operations are all performed by an automatic machine, no longer manually by workers. So, various carton machines have been offered by makers, but generally having the same operating method to sending out carton material boards by a material feed device and moved into a forming device for from it into a carton, and one example is shown in FIG. 9.

The carton machine shown in FIG. 9 has a forming device 10 to form a carton material board into a carton. The device 10 mainly has a first sucking disc 101 and a second sucking disc 103 pivotally connected to a connecting rod unit 102. A crank 104 is provided under the connecting rod unit 102 and pivotally connected to an output shaft of an oil pressure cylinder 105. When a carton material board is moved onto the first sucking disc 101, it is sucked to the first sucking disc 101, and then the oil pressure cylinder 103 immediately operates to carry the connecting rod units 102 move down and let the second sucking disc 103 move down in parallel to suck a carton material board. When the oil pressure cylinder 105 operates again, carrying the second sucking disc 103 move up in parallel, forming a flat carton material board into a carton shape.

The forming device just described above used the oil pressure cylinder 105 to move the second sucking disc 103 up and down for picking material and forming into a carton. But the output shaft of the oil pressure cylinder 105 needs not a little time in moving out and in, so therefore carton forming is slow, making up a disadvantage of the machine.

SUMMARY OF THE INVENTION

The main objective of the invention is to offer a material picking device and a forming device for an automatic circulating carton opening machine. The two devices are fixed on an intermediate portion of the table of the machine, and the material picking device includes a revolving unit and the forming device includes a forming guide plate. The revolving unit includes an elongate swinging arm, two rotating gear units fixed at two ends of the swinging arm. Each gear unit has a belt wheel at the outermost end connected to two parallel arms fixed with two material sucking discs. The forming guide plate is positioned on an intermediate portion of the table in front of the revolving unit and at one side of the moving route of the swinging arm. So, the two parallel arms are moved horizontally by operation of the rotating gear units of the swinging arm, and then the sucking discs continuously and alternately pick a carton material board from the material feed device of the machine, carrying the carton material board to let the board lie on the forming guide plate to be formed into a carton shape. Thus the two sucking discs alternately and continuously pick a carton material board, greatly increase operating speed of the automatic circulating carton opening machine.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
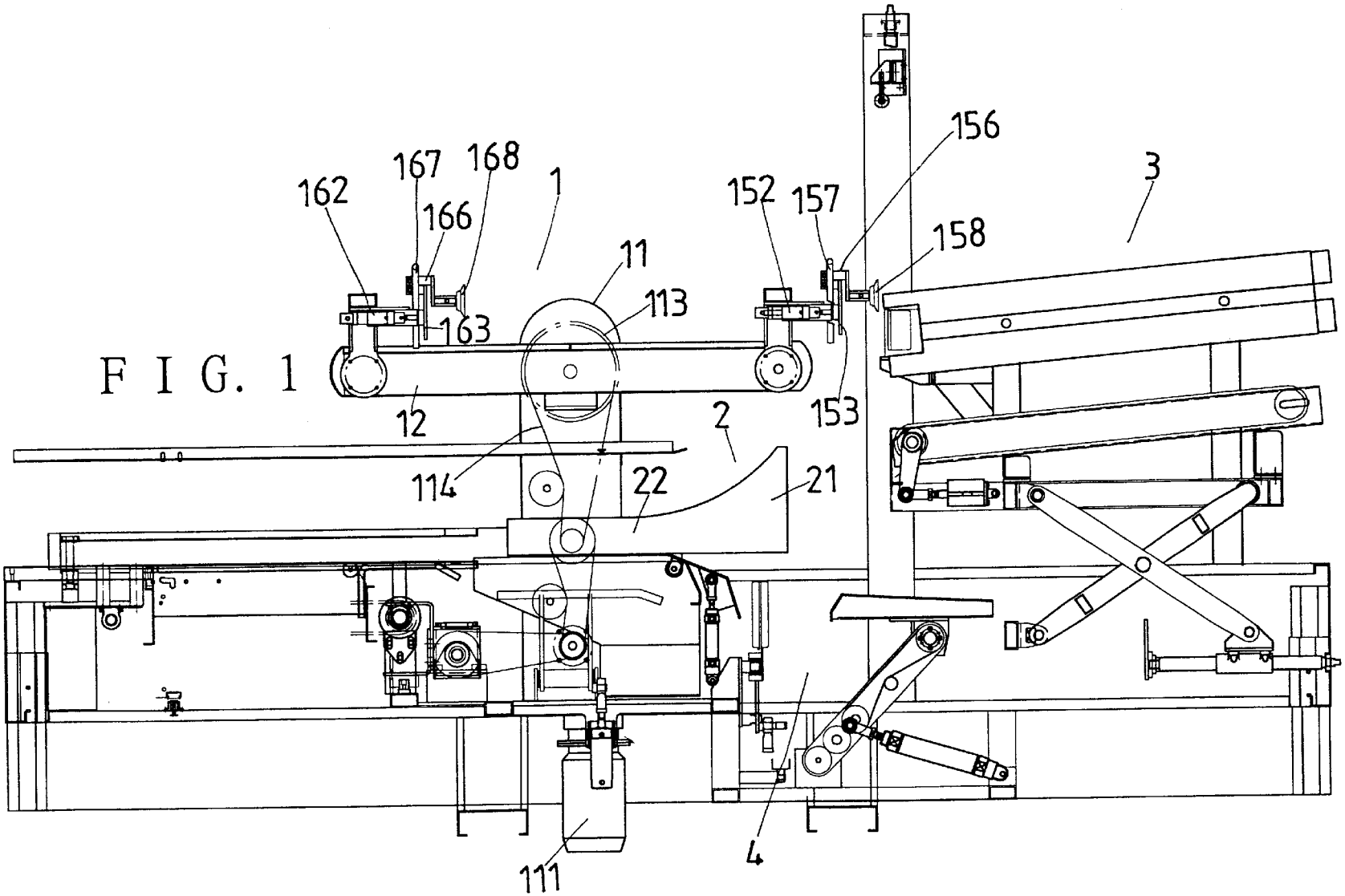
FIG. 1 is a front view of a material picking device and a forming device for an automatic circulating carton opening machine of the present invention.
Figure 2:
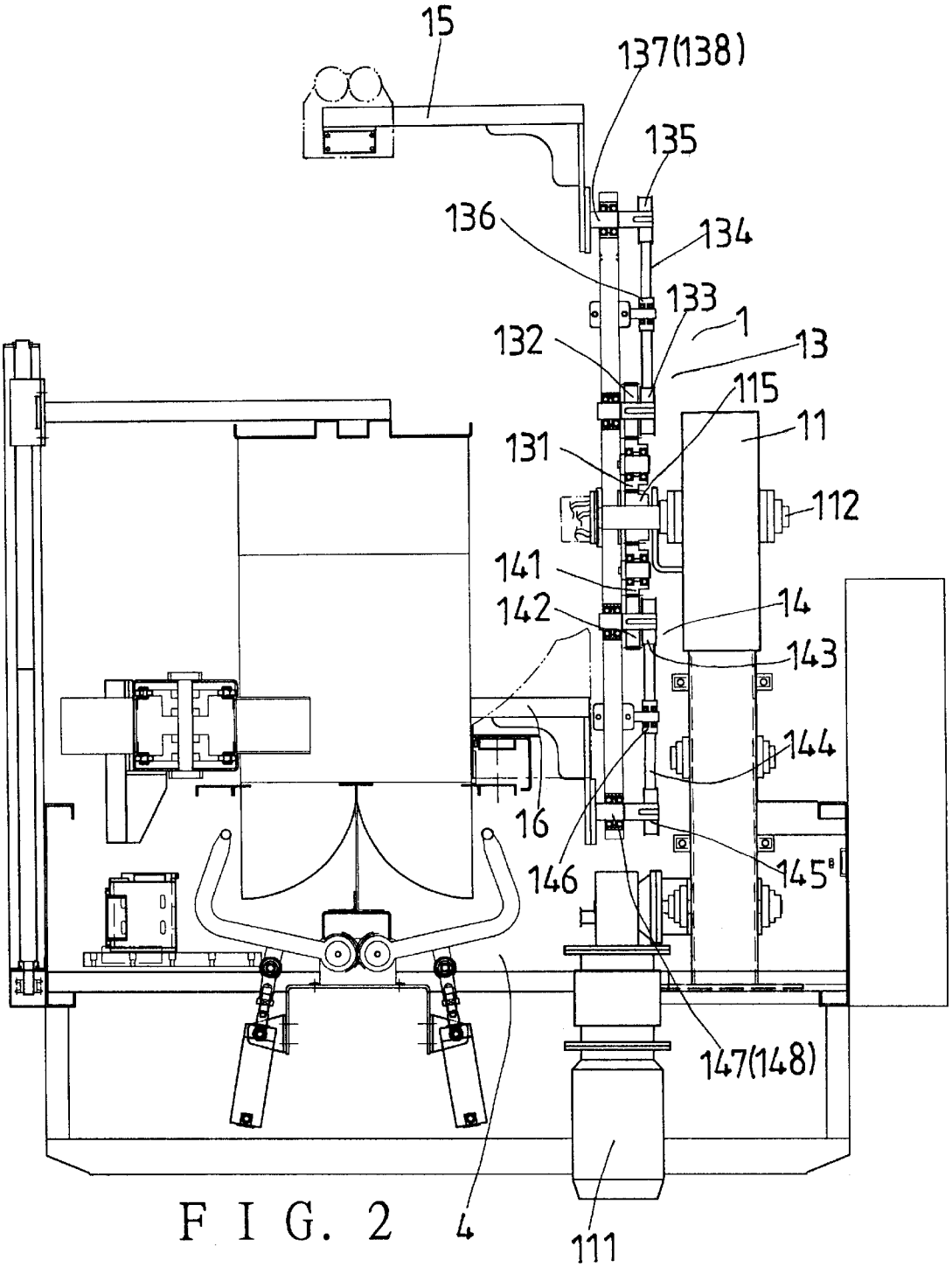
FIG. 2 is a side view of the material picking device and the forming device for an automatic circulating carton opening machine of the present invention.
Figure 3:
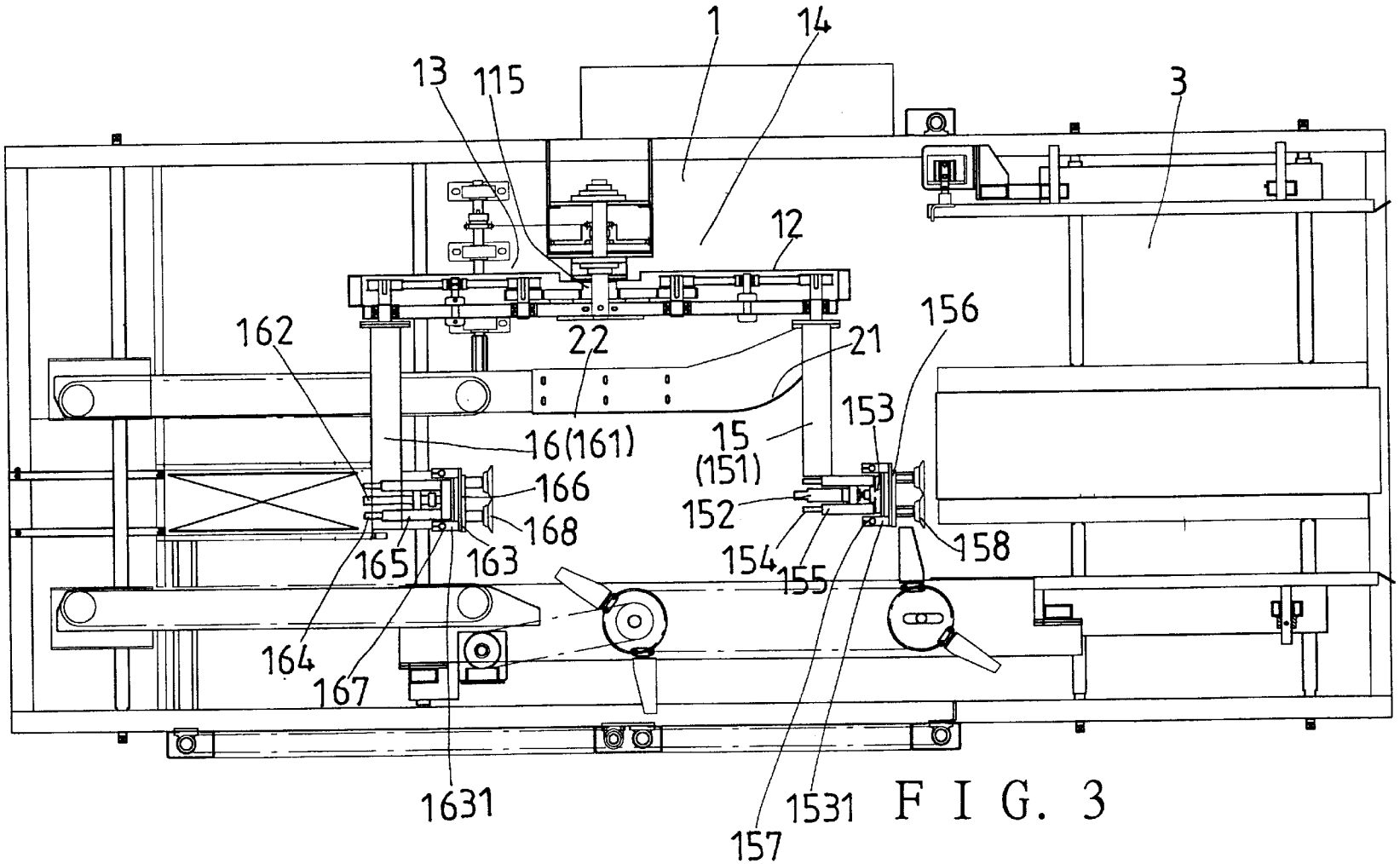
FIG. 3 is an upper view of the material picking and forming device for an automatic circulating carton opening machine of the present invention.

A preferred embodiment of a material picking and forming device of the present invention is positioned on an intermediate portion of the table of an automatic circulating carton opening machine. The material and forming device includes a revolving unit 1 and a forming guide plate 2, for quickly picking and forming a carton to cooperate with an material feed device 3 and a cover folding device 4 of the automatic circulating carton opening machine. But the material feed device 3 and the cap folding device 4 is not to be described, as they are not included in the application.

The revolving unit 1 includes a support rod 11 fixed upright on an intermediate portion of the table of the carton opening machine, a motor 111 positioned at a bottom of the support rod 11, a shaft 112 provided on top of the support rod 11, a chain wheel 113 fixed on the shaft 112, an endless chain 114 moving around the motor 111 and the chain wheel 113. Then the motor 111 rotates the shaft 112, which has its one end fixed with a transmitting wheel 115 and a swinging arm 12 so that the swinging arm can swing around with the shaft 112 as a pivot. Further two rotating gear units 13, 14 are provided at two sides of the transmitting gear 115 on two sides of the swinging arm 12. The rotatable gear units 13, 14 each have a connect gear 131, 141 engaging with the transmitting gear 115, and a middle gear 132, 142 also engaging with the connect gear 131, 141. Then two transmitting belt wheels 133, 143 are each provided side by side with the middle gears 132, 142, and a timing belts 134, 144 are provided and each connected between the transmitting belts 133, 143 and the belts 135, 145 at the other end of the swinging arm 12. Then press wheels 136, 146 are each provided on the swinging arm 12 between the two timing belts 134, 144 so as to press the outsides of the same belts 134, 144.

Next, the two belt wheels 135, 145 at two ends of the swinging arm 12 have shafts 137, 147, and two rotatable joints 138. 148 are each fixed on the shafts 137. 147 for fixing two parallel arms 15, 16 having the same structure. The parallel arms 15, 16 each have arm rods 151, 161, and two air pressure cylinders 152, 162 are each fixed on the other end of the arm rods 151, 161 horizontally, having output shafts each fixed with base plates 153. 163, and two slide rods 154, 164 are each fitted in two sleeves 155, 165 extending out from the base plates 153, 163. Further, two adjusting bases 1531, 1631 are each fixed above the base plates 153, 163 for support rods 157, 167 of upper base plates 156, 166 to fit tightly in to adjust the height of the upper base plates 156, 166. Then two material sucking discs 158. 168 are each fixed on the upper base plates 156, 166. Then the sucking discs 158, 168 extend out to suck up a carton board in due time when the swinging arm is swung to a horizontal condition. The sucking discs 158. 168 each have wind pipes to combine with the rotatable joints 138. 148 of the swinging arm 12. Then when the swinging arm 12 with the two parallel arms 15. 16 swing, the rotatable gear units 13, 14 operate to keep the parallel arms 15, 16 and the sucking discs 158, 168 in the horizontal condition and connected with a vacuum source.

The forming guide plate 2 is fixed on the intermediate portion of the table in front of the revolving unit 1, positioned at one side of the moving route of picking carton material board when the parallel arms 15, 16 of the swinging arm 12 swing, having a guide section 21 formed to curve outward in a front portion and a flat forming section 22 formed in the end section extending from the guide section 21. Then when a flat carton material board is sucked up by the sucking discs 158, 168 and moved into the operating area of the forming guide plate 2, the carton material board is formed into a carton shape.

Figure 4:
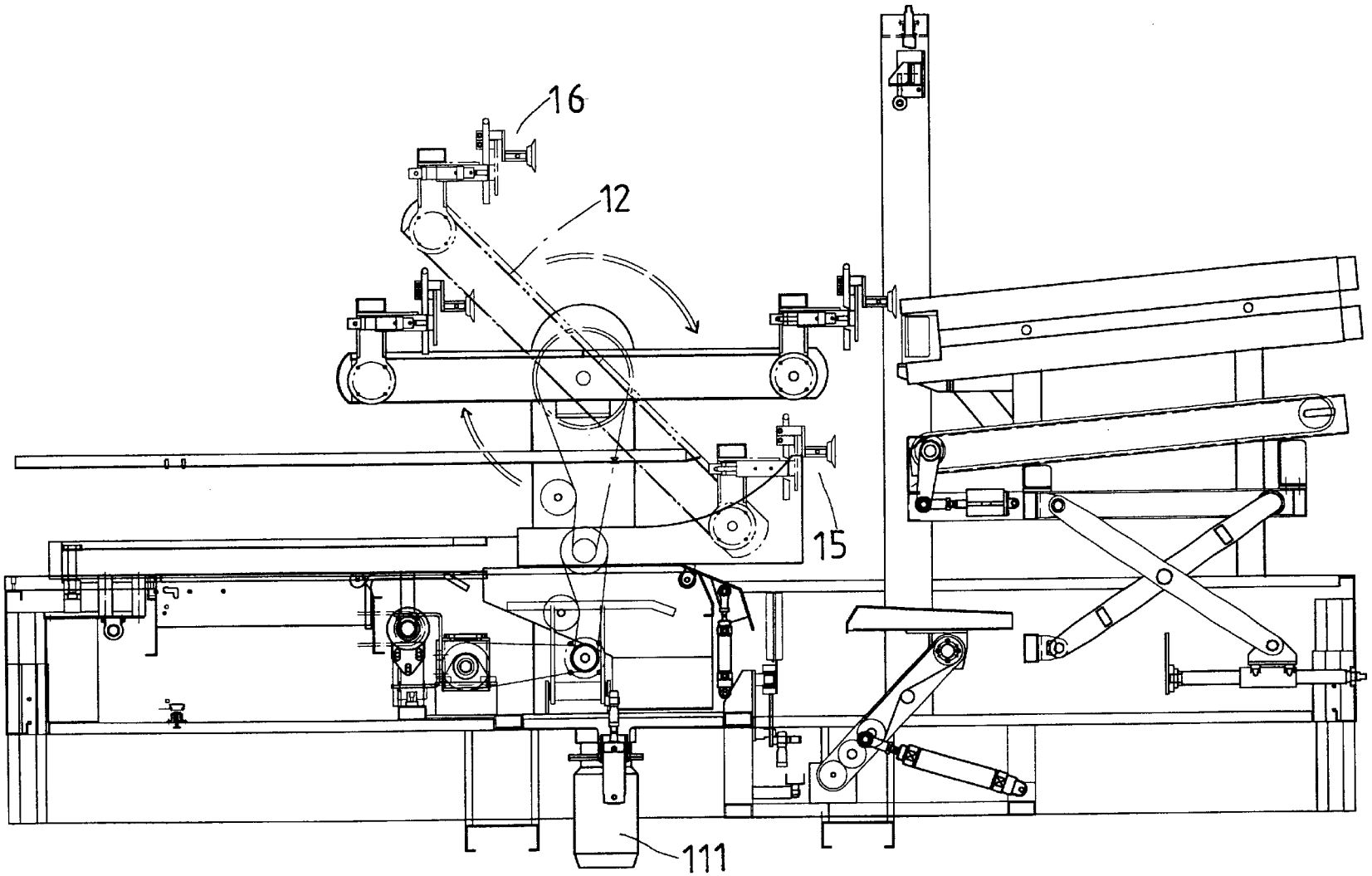
FIG. 4 is a side view of a swinging arm under swinging condition of the present invention.

In using, as shown in FIG. 4, the motor 111 of revolving unit 1 is powered to swing the swinging arm 12 with a preset speed, with the rotatable gear units 13, 14 also operating, permitting the two parallel arms 15, 16 at two ends of the swinging arm 12 and the sucking discs 158, 168 kept horizontal by means of alteration of teeth ratio of the various gears of the rotatable gear units 13, 14 and the arrangement of the belts.

Figure 5:
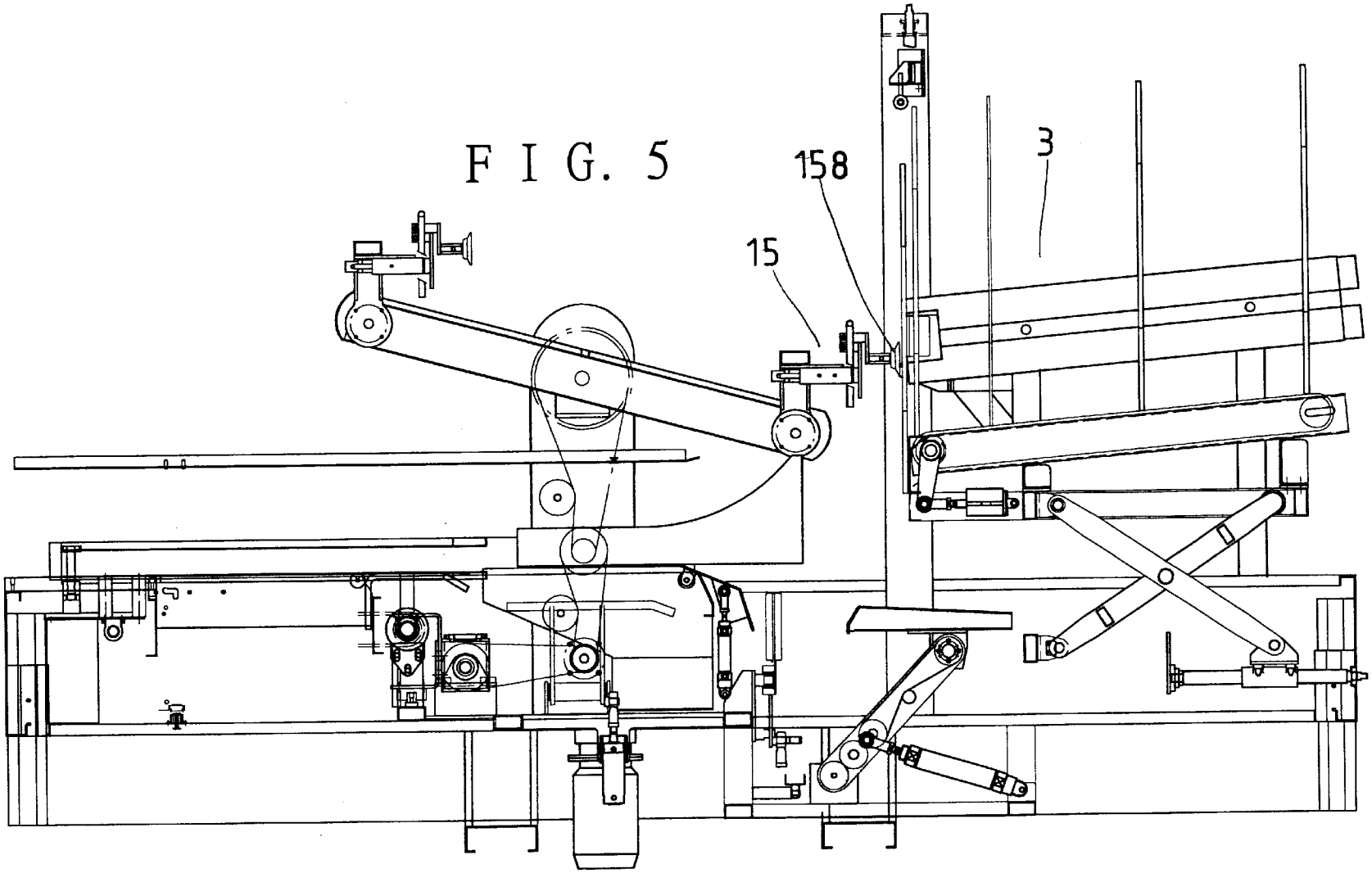
FIG. 5 is a side view of a sucking disc in picking material of the present invention.
Figure 6:
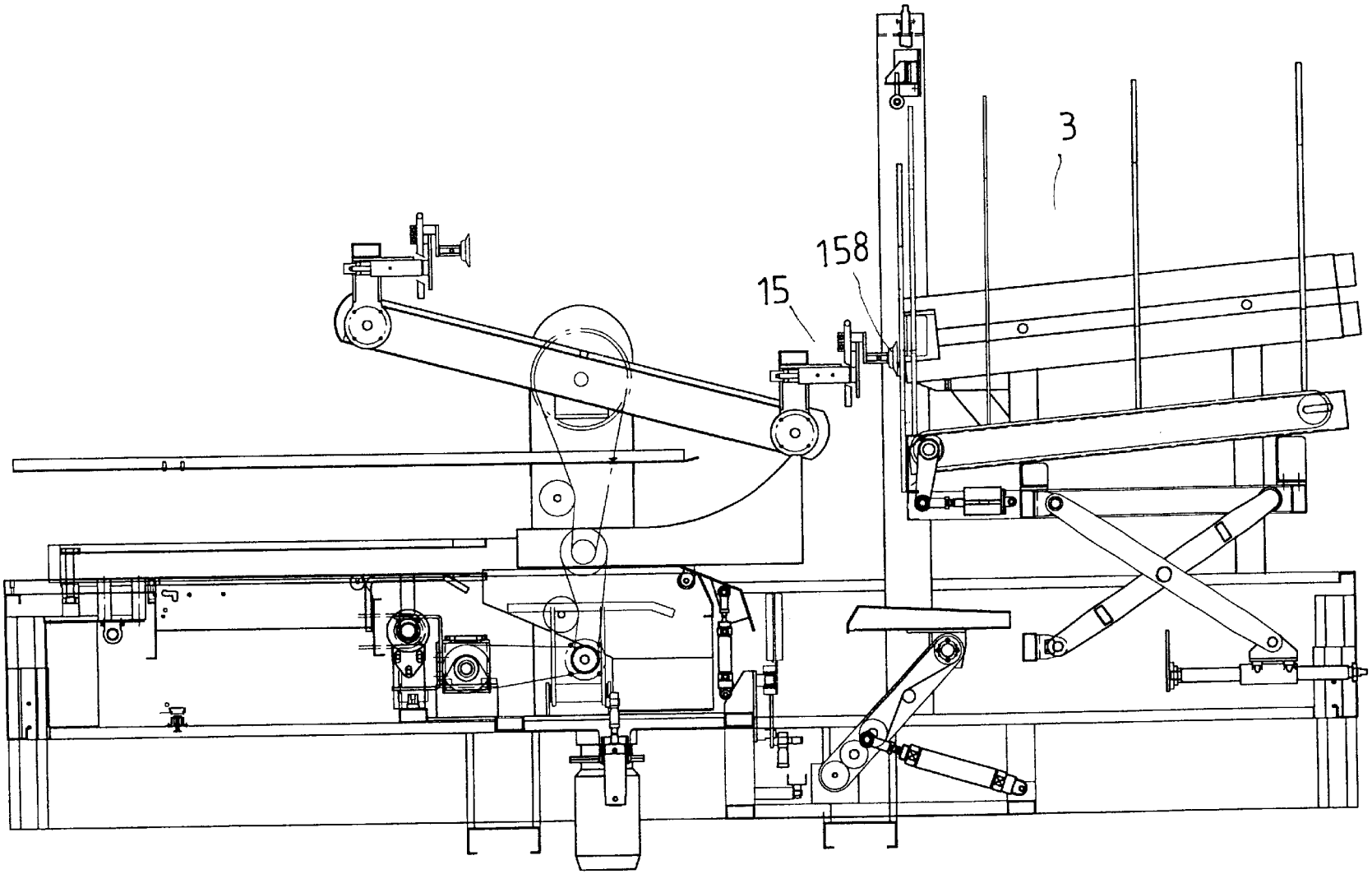
FIG. 6 is a side view of the swinging arm swing down for the sucking disc to pick material of the present invention.
Figure 7:
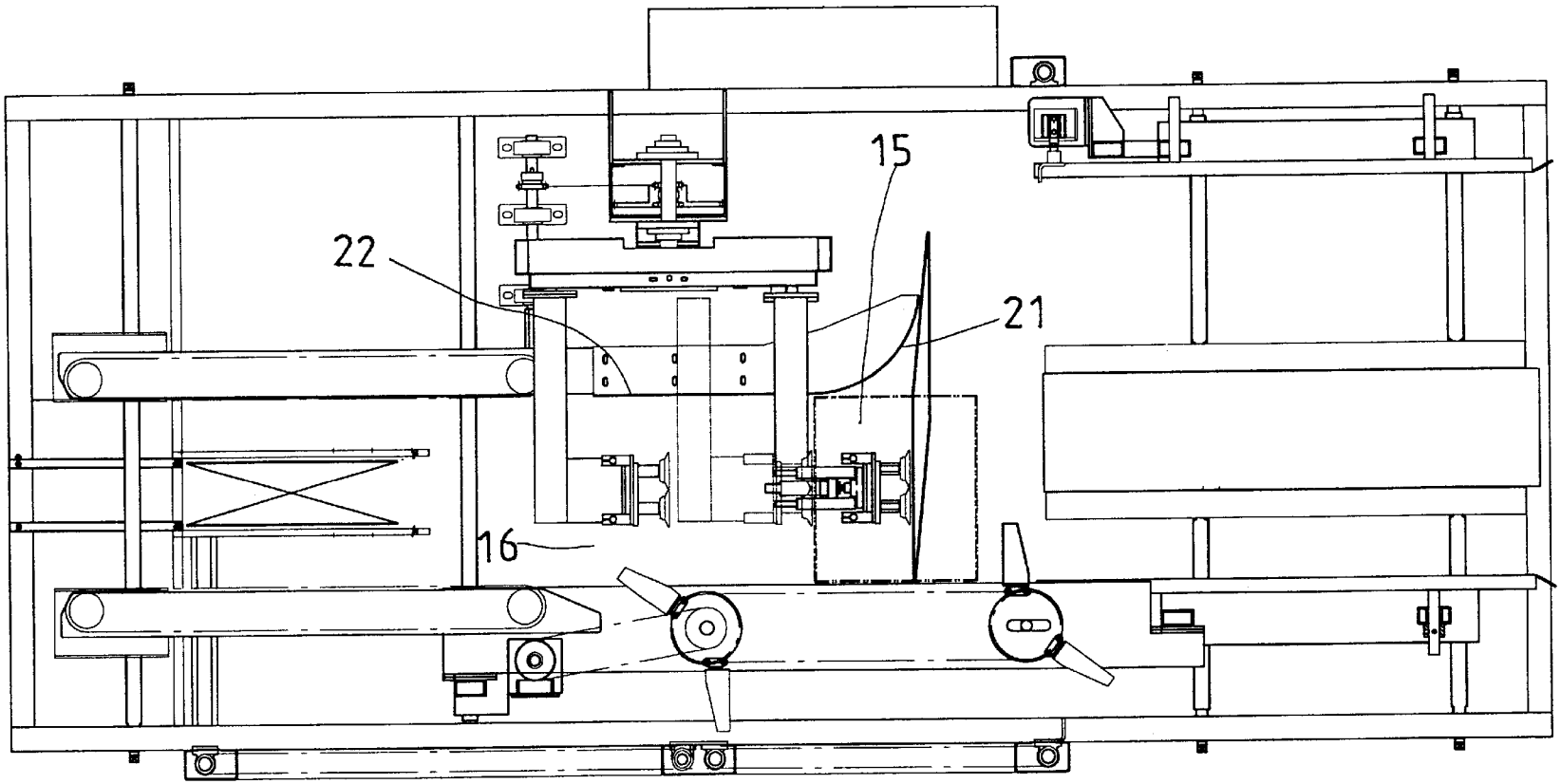
FIG. 7 is a side view of a carton formed by a board material by the material picking and forming device of the present invention.

When the swinging arm 12 moves to the horizontal position, one of the sucking discs 158 moves to the material picking position in line to the material feed device 3 as shown in FIG. 5. Then the sucking disc 158 can be pushed to move into the material feed device 3 and suck the right side of a carton material board, continually move down with the swinging arm 12 to pull out the carton material board from the material feed device 3 as shown in FIG. 6.

As a carton material board is pulled out by the sucking disc 158 by swinging of the swinging arm 12, the sucking disc 158 is kept moving down with the swinging of the swinging arm 12, letting the other side of the carton material board touch the guide section 21 of the forming guide plate 2. Then the carton material board gradually moves on the guide section 21 and onto the flat forming section 22 and pass the same section 22 to become a 3D carton, which is moved at the same time into the cap folding device 4, wherein the bottom of the carton is folded.

Figure 8:
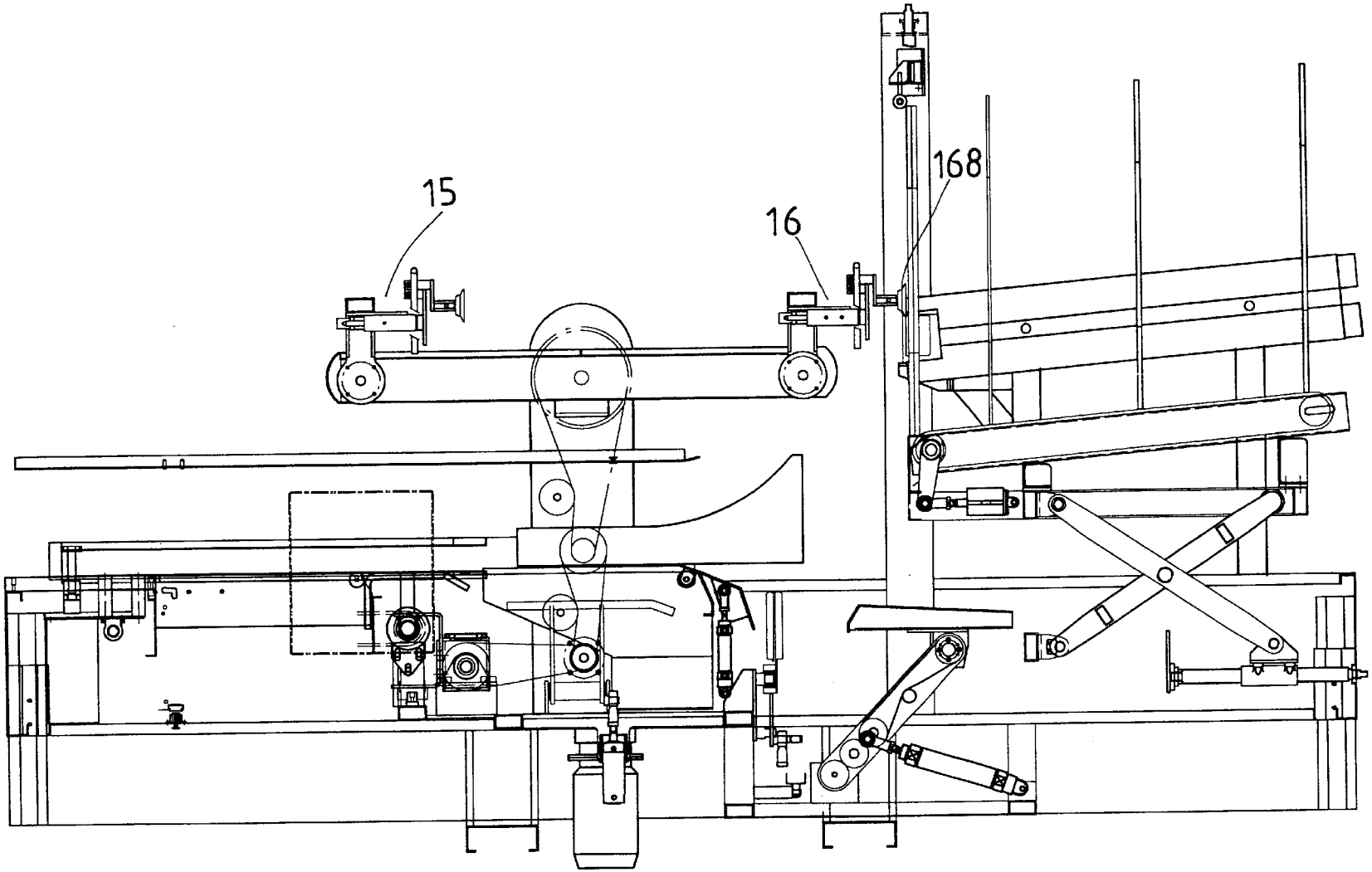
FIG. 8 is a side view of the sucking disc at an end of the swinging arm moving down of the present invention.
Figure 9:
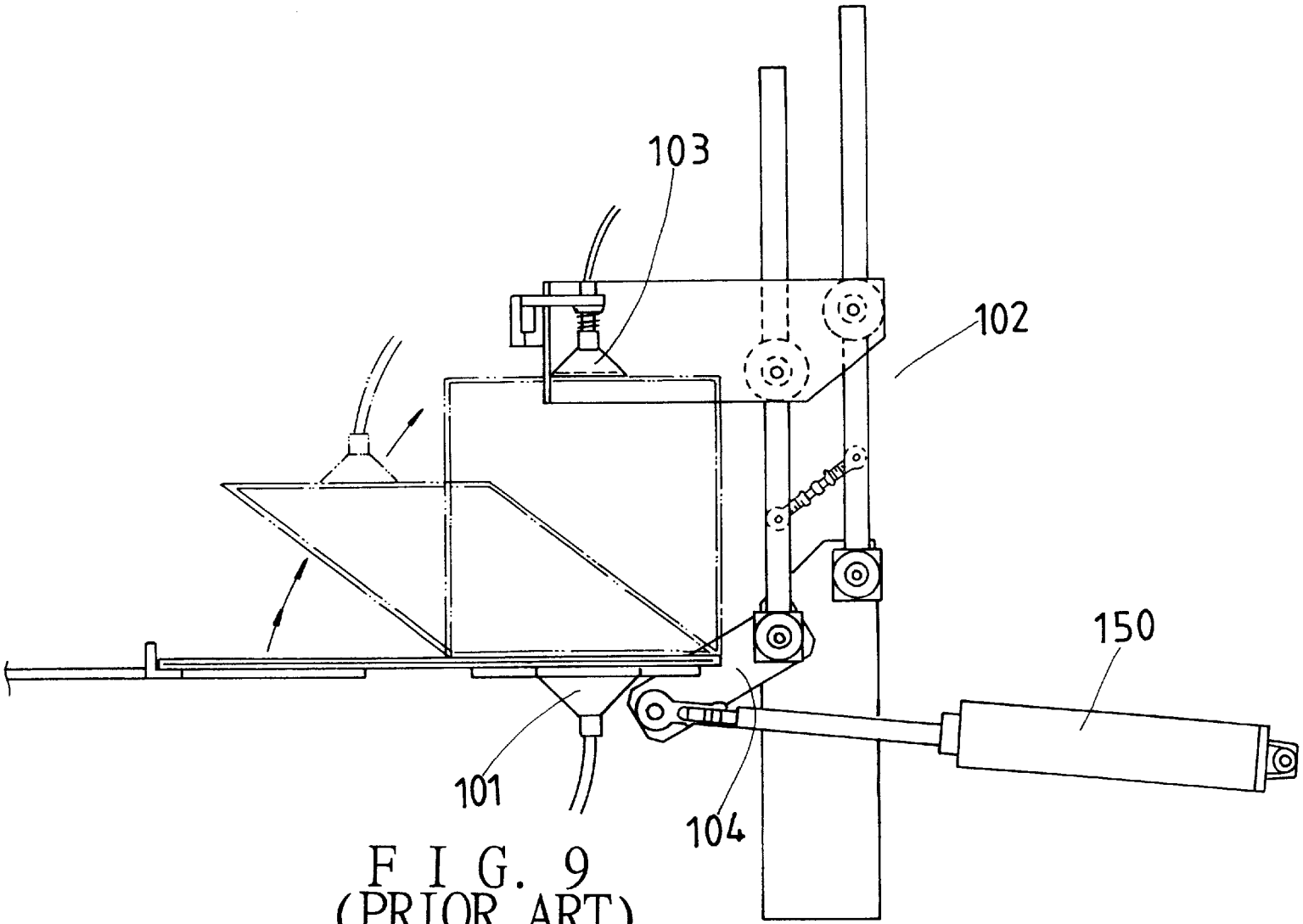
FIG. 9 (PRIOR ART)
FIG. 9 is a side view of an opening device and its opening action of an opening device disclosed in a patent of published No. 278459.

After the carton is moved into the folding device 4, and moved forward by a convey belt 41, the sucking disc 158 at one end of the swinging arm 12 also passes a lower dead point, releases the carton and rotates to move up. Then the other sucking disc 168 begins to move down as shown in FIG. 8. When the swinging arm 12 becomes horizontal again, the second sucking disc 168 picks a carton material board out of the material feed device 3 and carries it into the operating area of the forming guide plate 2 under swinging of the swinging arm 12. And the same action is repeated as described above. The swinging of the swinging arm 12 permit the sucking discs 158, 168 alternately pick a carton material board out of the material feed device 3 for forming a carton.

As understood from the aforesaid description, swinging of the swinging arm 12 can let the sucking discs 158, 168 at the two ends of the swinging arm 12 move parallel to continuously and quickly pick a carton material board out of the material feed device 3 to form the bottom of a carton, largely speeding material picking and carton forming operation of the automatic carton opening machine.

What is claimed is:

1. A material picking and forming device for an automatic circulating carton opening machine, comprising a material picking device and a forming device both fixed on an intermediate portion of a table of an automatic circulating carton opening machine, said material picking device having a revolving unit, said forming device having a material guide plate;

said revolving unit including a vertical support rod, a shaft fixed on said support rod and rotated by a motor, a transmitting gear and a swinging arm fixed at one end of said shaft, a rotatable gear unit positioned respectively at two sides of said swinging arm and said transmitting gear, each said rotatable gear having a connect gear engaging with said transmitting gear and with a middle gear, a transmitting belt wheel disposed adjacent said middle gear, a timing belt connected between said transmitting belt wheel and belt wheels at two ends of said swinging arm, said belt wheels having a shaft and a rotatable joint fitting in said shaft to combine with two parallel arms of the same structure, arm rods of said two parallel arms having one end fixed with an air pressure cylinder, each said air pressure cylinder having an output shaft for pushing a material sucking disc, each said sucking disc being operable to pick a carton material board out of a material feed device;

said forming guide plate fixed on an intermediate portion of a table of said carton opening machine in front of said revolving unit, positioned at one side of a moving route of said sucking discs at two opposite ends of said swinging arm, having a front curved out guide section and a flat section extending from said curved out guide section for forming cartons;

said parallel arms and said sucking discs moving horizontally by the operation of said rotatable gear unit and alteration of teeth proportion when said swing arm swings, said sucking discs alternately picking a carton material board and carrying it to said forming guide plate, said carton material board lying on said forming guide plate to become a carton to thereby increase the speed of the material picking and carton forming operation of said automatic carton forming machine.

2. The material picking and forming device for an automatic circulating carton opening machine as claimed in claim 1, wherein said shaft of said support rod of said revolving unit is fixed with a chain wheel having an endless chain moving around it and the motor.

3. The material picking and forming device for an automatic circulating carton opening machine as claimed in claim 1, wherein a press wheel is further provided on said swinging arm to press a middle portion of each said timing belt of said rotatable gear unit of said revolving unit.

4. The material picking and forming device for an automatic circulating carton opening machine as claimed in claim 1, wherein said sucking discs are fixed on upper base plates, said upper base plates each having a support rod fitting into adjustable bases of said upper base plates at the other ends of said output shafts of said air pressure cylinders, and thus said sucking discs are adjustable in their height.

* * * * *